United States Patent [19]

Kalyan et al.

[11] 4,050,544

[45] Sept. 27, 1977

[54] LUBRICATION SYSTEM FOR AN AIR MOTOR

[76] Inventors: Jagdish C. Kalyan, 822 NE. 62nd, Seattle, Wash. 98155; Bryan J. Dickinson, 24219 Marine View Drive, Des Moines, Wash. 98016

[21] Appl. No.: 638,850

[22] Filed: Dec. 8, 1975

Related U.S. Application Data

[63] Continuation-in-part of Ser. No. 465,862, May 1, 1974, abandoned.

[51] Int. Cl.[2] ..... F01M 1/04

[52] U.S. Cl. ..... 184/6.6; 64/23; 91/180; 91/491; 184/6.18; 184/7 R

[58] Field of Search ..... 184/6.6, 1.5, 6.18, 184/6.19, 8, 12; 64/23, 1 V; 91/502, 503, 491, 46, 180; 92/153; 417/273; 308/238

[56] References Cited

U.S. PATENT DOCUMENTS

| | | | |
|---|---|---|---|
| 2,003,563 | 6/1935 | Szekely | 184/6.6 |
| 2,498,828 | 2/1950 | Sheppard | 184/6.18 X |
| 3,093,301 | 6/1963 | Mitchell | 92/154 X |
| 3,686,895 | 8/1972 | Easley | 64/23 X |
| 3,696,710 | 10/1972 | Ortelli | 91/180 X |
| 3,730,054 | 5/1973 | Dickinson | 91/491 |
| 3,869,962 | 3/1975 | Austin et al. | 184/55 R X |

FOREIGN PATENT DOCUMENTS

| | | | |
|---|---|---|---|
| 530,631 | 12/1940 | United Kingdom | 184/6.5 |
| 629,052 | 9/1949 | United Kingdom | 184/6.19 |

*Primary Examiner*—Richard C. Pinkham
*Assistant Examiner*—Arnold W. Kramer

[57] ABSTRACT

A lubrication system for an air motor which incorporates a positive feed oil pump, driven by the air motor, which forces lubricant, under pressure to the majority of critical lubrication zones. Because of manufacturing tolerances as well as ease of maintenance, the rotary valve and the main crankshaft are coaxial but separate. The lubricant is forced inwardly to the axis of either the crankshaft or the rotary valve and then transmitted to the other rotating member by way of a hollow elastic snubber which preloads the valve and crankshaft in opposite directions.

6 Claims, 3 Drawing Figures

LUBRICATION SYSTEM FOR AN AIR MOTOR

BACKGROUND OF THE INVENTION

This application is a continuation-in-part of U.S. patent application Ser. No. 465,862 filed May 1, 1974, and now abandoned.

The utilization of an air motor has many advantages over internal combustion engines and/or an electric motor in many and various applications. Particular specific applications are well known and will not be elaborated upon at this point.

One of the advantages of the utilization of an air motor is its versatility with respect to operating position and the amount of usable power which may be generated from a supply of relatively low air pressure.

One standard configuration of an air motor includes the coaxial alignment of the rotary valve which controls the motor and the actual crankshaft. Although it is technically possible, and sometimes done, to place the crankshaft and valve element on a common shaft, this requires extreme care in machining the casing since it would require the alignment of at least three bearings. A second disadvantage of the common shaft occurs in the event of a failure which would thus require replacement of the entire mechanism instead of only that portion which had failed. Hence, it is common practice to mount the valve and crankshaft coaxially, each utilizing its own set of bearings, and have the two interconnected by a drive means which accomodates any slight misalignment generated by casting or machining tolerances. One method of accomplishing the above is through the use of the interconnection as shown and described in U.S. Pat. No. 3,730,054, issued to Bryan J. Dickinson, a co-inventor herewith, on May 1, 1973 and incorporated herewith by reference.

One of the difficulties with an air motor, as well as with any other rotary assembly, is in the continual provision of adequate lubrication to prevent the destruction of the various parts. It has been traditional to supply a reservoir of lubricant within the sealed casing of the prior art air motors. Attempts have been made to lubricate the moving parts by splashing the oil stored in the reservoir by means of a rotating oil slinger. The most critical disadvantage of this approach to the problem is that at low rotational speeds the oil slinger is unable to sling oil properly, thus defeating the purpose of splash lubrication. The oil level becomes extremely critical when utilizing the splash lubrication technique and a slight error can result in failure. The slinger ring is unable to function if the oil level drops down beyond a certain level. Further, the centrifugal forces caused by mere rotation of the parts requiring lubrication prevents the oil from reaching the various critical moving parts, those most hungry for lubricant.

Another method which has been used in an attempt to lubricate the various relatively moving parts has involved positively pumping lubricant to a point in the casing above the moving parts and then allowing the lubricant to drip onto the parts from various appropriately placed passages. This has generally proven to have some advantages over the splash lubrication approach, however, here again where there is need for lubricant at positions which are generally behind or shielded from the lubricant source it is very difficult to assure that the lubricant will reach the internal parts and provide adequate lubrication.

Prior art noted by the present inventor which are directed to lubrication systems but not considered pertinent nor anticipatory of the present invention are U.S. Pat. No. 1,945,338, granted Jan. 30, 1934 to Terry; U.S. Pat. No. 2,663,339, granted Dec. 22, 1953 to Verderber; U.S. Pat. No. 3,036,658, granted May 29, 1962 to Peterson; U.S. Pat. No. 3,093,301, granted June 11, 1963 to Mitchell; U.S. Pat. No. 3,130,818, granted Apr. 28, 1964 to Smith et al; U.S. Pat. No. 3,587,406, granted June 28, 1971 to Gannaway and U.S. Pat. No. 3,516,516, granted June 23, 1970 to Bertva, et al. In addition, one of the present inventors has a U.S. Pat. No. 3,869,962, granted Mar. 11, 1975 which is likewise directed to a lubrication system for an air motor.

As noted above the patents listed are references noted with respect to lubricating systems in general. It is further noted that none of these systems utilize a positive force fed lubricant system which carries lubricant to the center of the crank and/or drive shaft and then is fed radially outwardly to lubricate bushings or other structures which are virtually impossible to reach from the exterior of the assembly.

Other references known by the inventor dealing with forced lubrication from within a crankshaft include U.S. Pat. No. 1,229,569, granted June 12, 1917 to Augustine; U.S. Pat. No. 1,288,302, granted Dec. 17, 1918 to Vincent; U.S. Pat. No. 1,338,310, granted Apr. 27, 1920 to Lawrence, U.S. Pat. No. 1,903,411, granted Apr. 4, 1933 to Wodson; French Patent No. 662,567 granted Mar. 19, 1929 to Brownback; and British Patent No. 231,452, granted Dec. 10, 1925 to Panhard.

Whereas these references deal broadly with the forced lubrication from within a rotating shaft outwardly to the critical part, none deal specifically with the problems inherent in transmitting lubricant from one rotating shaft to another nor do they anticipate the particular herein disclosed solution.

With the above noted prior art and disadvantages in mind it is an object of the present invention to provide a positive lubrication system for an air motor mounted with a relatively vertical orientation such that the lubricant is continuously supplied to all areas needing positive feed for adequate protection.

It is another object of the present invention to provide a novel lubrication system for use in any rotating assembly wherein the most adequate lubrication is provided by means of a positive flow fed outwardly from the center of a rotating shaft and transmitted from one shaft to another.

Still another object of the present invention is to provide a positive assembly and interconnection whereby lubricant or other fluid under pressure may be passed from a relatively fixed portion of the assembly to the interior of a rotating shaft portion of the assembly with little or no loss of pressurized fluid.

Yet another object of the present invention is to provide an air motor adapted to be used with the output shaft in a relatively vertical orientation and including means to continuously and positively feed lubricant from within a rotating shaft to those parts in contact therewith.

Still a further object of the present invention is to provide a forced lubrication system to properly lubricate parts of an assembly which are above the oil reservoir wherein said system utilizes the casing and other necessary elements of the assembly to channel the lubricant and therefore introduces no additional structure to the already crowded interior portion of the casing.

A still further object of the present invention is to provide a means whereby lubricant is transmitted from the axis of one rotating shaft mounted in one set of bearings to the axis of another substantially coaxial shaft mounted in a second set of bearings.

Yet another object of the present invention is to provide a lubricant transmitting means between two rotating shafts which simultaneously preload the shafts preventing lateral shifting of these shafts caused by external forces.

DETAILED DESCRIPTION OF THE DRAWINGS

Figure 1:
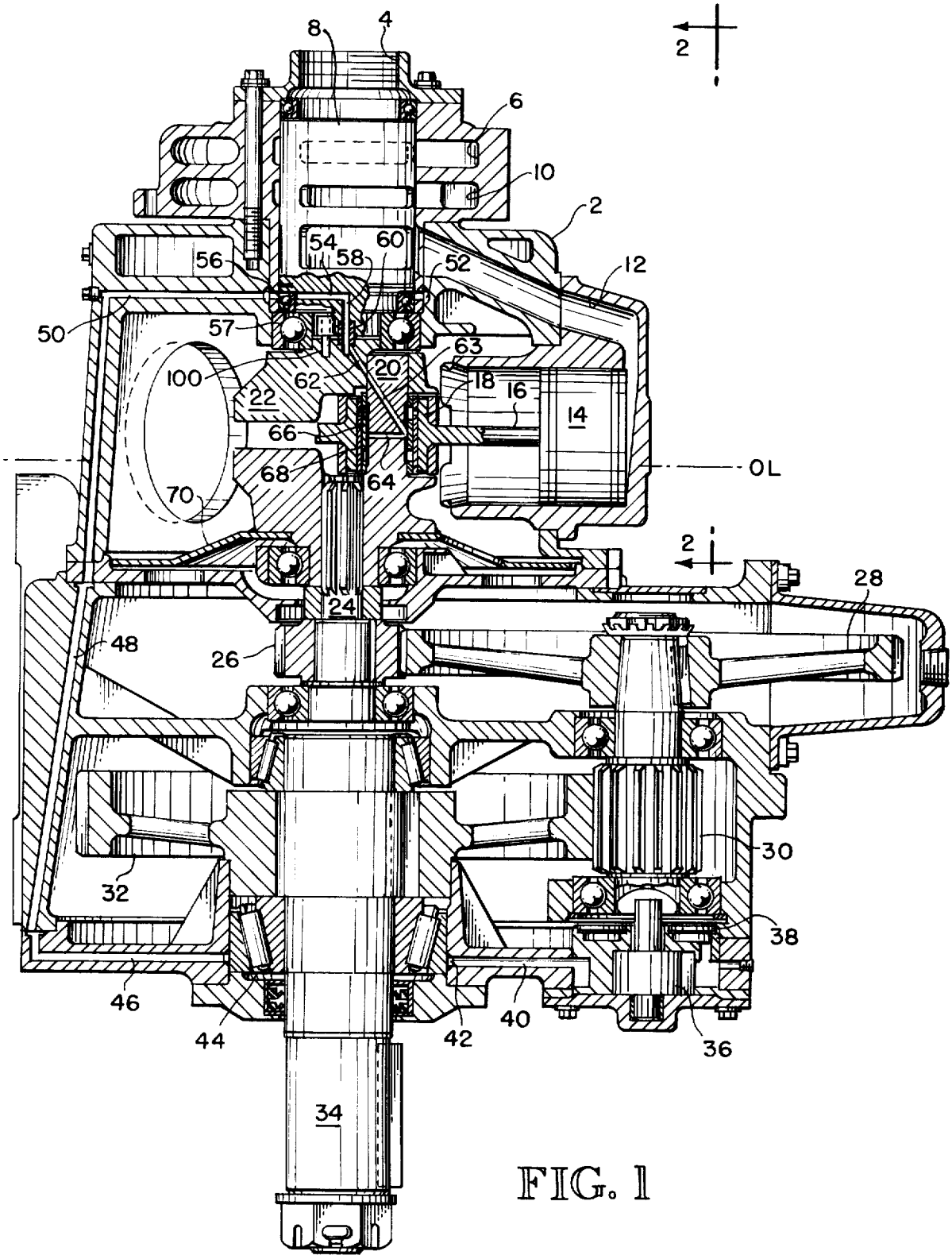
FIG. 1 is an elevational view taken in section through an air motor incorporating the inventive lubrication system.

As seen in FIG. 1 the present air motor includes, as an integral part thereof, many standard features which will not be described in detail herein since they do not form a direct portion of the present invention. The air motor structure is enclosed within a sealed casing 2 such that contaminants are kept out and a reservoir of lubricant is retained within the casing. The casing includes an exhaust port 4 to permit escape of the air after the air has been utilized to drive the pistons. It is the escape of the air that places axial forces upon the rotary valve. Air under pressure is received at inlet 6 or 10, passes through rotary valve 8 whereat it is directed to the appropriate piston structure in order to drive the pistons. After the useful work the air is exhausted to main exhaust port 4 and whatever air is not exhausted from main exhaust 4 is allowed to exhaust through a scavenger exhaust which is also one of the two possible inlet ports 6 or 10. If 6 is used as an inlet port 10 becomes scavenger exhaust and if 10 is used as inlet port, 6 becomes scavenger exhaust. Air under pressure, after passing through rotary valve 8, passes through conduit 12 to a cylinder assembly where it drives a piston 14 connected by means of a wrist pin (not shown) to a connecting rod 16. Connecting rod 16 includes, at the radially inward end thereof a shoe or foot 18. As seen, and to be described in greater detail hereinafter, the shoe 18 is in continuous contact with a bushing which is mounted upon a crankshaft sleeve which in turn is mounted on crankshaft 20. There is no relative motion between crankshaft and crankshaft sleeve. Keyed to crankshaft 20 is a counterweight 22 to assure a smooth and continuous motion of the crankshaft during the various coordinated strokes of the multiplicity of pistons. The crankshaft 20 is splined to a drive shaft 24 which is keyed to a high speed pinion 26 which is in mesh with a reduction gear 28. Reduction gear 28 is keyed to a low speed pinion 30 which in turn drives a second reduction gear 32 keyed to the output shaft 34.

Mounted within casing 2 and driven by pinion gear 30 is an oil pump 36 which draws lubricant from the reservoir through filter screens 38 and forces the lubricant diametrically across the casing by means of conduit 40 to an annular groove 42 which carries the lubricant around bearing 44 to interconnect with a second conduit 46 which channels the lubricant to the outer edge of the casing 2. The lubricant is then urged upwardly through angular conduit 48 to a point above the piston assembly. A radial conduit 50 carries the lubricant inwardly toward the center of the air motor or the axis of rotation of the output shaft and the rotary valve 8. An annular groove 52 then carries the lubricant in a circular path around the rotary valve housing and provides a small reserve of lubricant under pressure for use as demanded.

Within the housing of the rotary valve are a plurality of radial holes 54 which are in alignment with the radial groove 52 and carry lubricant radially inwardly from the groove 52. Since there is lubricant continuously within the groove 52, the holes 54 are continuously supplied with lubricant under pressure. The lubricant lubricates bearing 56 and the remainder of the lubricating fluid is transmitted to an axial hole 58 which carries the lubricant downwardly through hollow sealing collar or snubber 60 to interconnect with an angular conduit 62 which carries the lubricant to the center of the crankshaft 20. At a position within the crankshaft 20 along the path of movement of the multiplicity of pistons 14 is a diametrical bore 64 which carries the fluid outwardly to bushings 66 and 68 which serve as an interface between the foot 18 of the connecting rod 16 and the crankshaft 20.

Air motors of the type disclosed herein, having a rotary valve element with an axial exhaust passage exhibit an undesirable characteristic during operation known as banging or hammering. This is caused by axial or lateral shifting of the rotary valve element against the crankshaft, bearings or housing members due to the pulsating unbalanced reaction force of air being exhausted axially from the valve. In addition to being noisy, the lateral shifting of the valve element substantially reduces the operating life of the valve and crankshaft bearing. Attention is directed to U.S. Pat. No. 3,730,054, noted hereinabove, for further discussion as the criticability of collar or snubber 60.

Further to be noted in this view, is the fact that the maximum lubricant level recommended by the manufacturer is designated by a horizontal line "OL" and all of the bearings and the like below this line would be lubricated by continual immersion. Mounted to the crankshaft 20 is an oil slinger 70 which will keep oil moving and splashing upwardly to lubricate the piston assemblies themselves.

Figure 2:
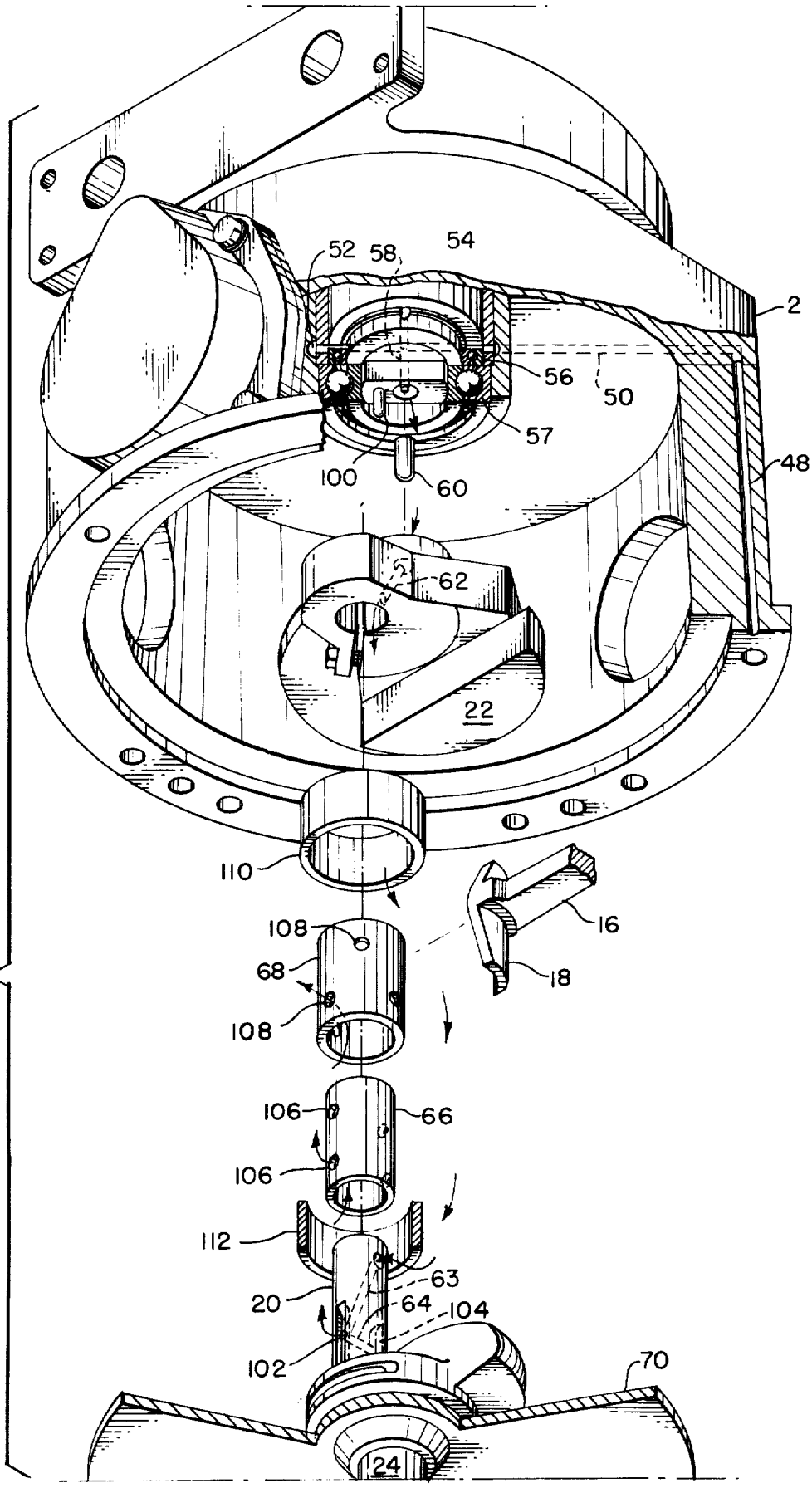
FIG. 2 is an exploded view of the upper portion of the air motor as viewed along lines 2—2 of FIG. 1.

Referring now to FIG. 2, which is an exploded view of the critical lubricating portion, it can be seen that the relatively vertical conduit or passage 48 completely within the housing 2 interconnects, as noted above, with transverse passage 50 leading into annular groove 52 which supplies lubricant to bearing 56 and 57. The lower portion of the rotary valve is locked by means of pin 100 to the counterweight 22. The lubricant flows downwardly through sealing collar or snubber 60 to enter the counterweight 22, passes through conduit 62 and thence downwardly to bushing 66 and 68. Thus, as can be seen, the collar or snubber 60 performs two simultaneous and critical functions, preloading the crankshaft and the rotary valve to increase life and reduce noise and providing a conduit for lubricant under pressure to pass from the axis of one rotating element to the axis of another.

As best seen in this figure, the lubricant after passing through conduit 63 and diametric passage 64 enters vertical keyways or slots 102 and 104 which allow the fluid under pressure to move the length of the interior bushing 66. Bushing 66 includes a plurality of ports 106 permitting the lubricant, which is under pressure, to pass outwardly and form a lubricating interface between bushing 66 and bushing 68. Bushing 68 likewise has a plurality of ports 108 permitting the lubricant to flow outwardly and from a film between the bushing 108 and the inward most portion of the foot 18 of connecting rod 16. The foot 18 of connecting rod 16 is retained in position against the bushing 68 by means of retaining rings 110 and 112.

When the air motor is in operation, the rotation of the crankshaft 20 causes the pistons to move inwardly and outwardly and since the pistons are rotationally relatively fixed there is movement between the bushing 68 and the crankshaft 20 as well as between the bushing 68 and the foot 18. There is no relative motion between sleeve 66 and crankshaft 20. The bushing 68 allows this relative movement and the foot 18 of the crankshaft 16 tends to operate in a walking motion, first one end being raised slightly from the bushing 68 and then the other. Thus, as can be seen with the liquid lubricant under pressure in the vertical slots 102 and the ports 106 and 108 as well as the slight walking motion of the foot 18 the lubricant has an adequate opportunity to move outwardly and provide lubrication for all of the critical parts.

Figure 3:
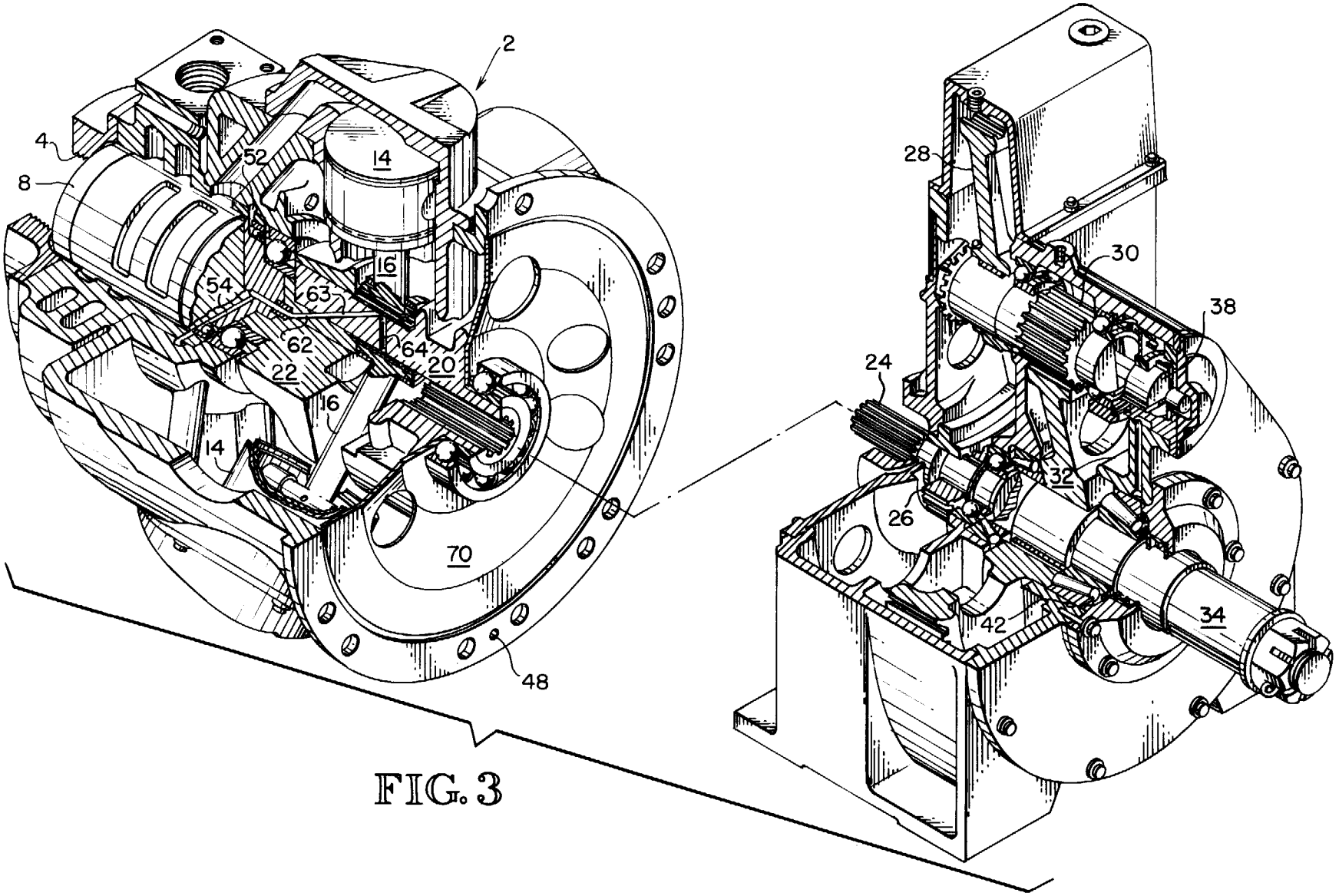
FIG. 3 is an isometric view, partially in section, showing the relative relationship of the various portions of the air motor incorporating the inventive lubrication system.

Reference is now had to FIG. 3 which for purposes of clarity places the entire assembly in an isometric view, partially broken away, and which depicts the portions in their relative positions. As seen in this view, the various elements are shown in their assembled position and the passage for the lubricant forced upwardly by means of pump 38 and then transversely inwardly by passages 54, 62, 63 and 64, may readily be seen.

Thus, as can be seen the present invention deals with the unique lubrication problems of an air motor and provides a unique means for resolving the problems. The lubricant is forced, under pressure, upwardly above the point normally occupied by the lubricant within the reservoir, forced inwardly under pressure to lubricate bearings and then downwardly and outwardly to lubricate the bushings which serve as the interface between the rotating crankshaft and the relatively fixed feet of the connecting rods driven by the pistons themselves. The lubricant passes from the axis of one rotating element, the rotary valve, to the axis of another rotary element, the crankshaft, passing through a resilient element which also serves to preload the elements preventing undesirable axial movement.

What is claimed is:

1. In an air motor having a rotary valve substantially coaxial with and adjacent to a crankshaft and including means drivingly interconnecting the two elements, a lubrication system to force-lubricate both elements, comprising:

a. a pump means to provide a continuous supply of lubricant under pressure, b. conduit means to carry lubricant from the pump to a conduit along the axis of rotation interior of the rotary valve, and c. means continuously conducting the lubricant from the rotary valve to the hollow interior conduit of the crankshaft during operation of the motor wherein the means for conducting the lubricant includes a hollow flexible member compressed between the two elements to form one continuous conduit between the conduits of the elements.

2. In a lubrication system as set forth in claim 1, and wherein bearings mounted along the throw of the crankshaft are lubricated by lubricant forced outwardly from within the crankshaft.

3. A lubrication system for apparatus having rapidly moving elements including a rotating shaft such as in an air motor, comprising:

a. hollow, coaxial, segmented shaft means, one segment being a rotary valve means and one a crankshaft means, b. a source of lubricant, c. pump means for supplying lubricant from said source under pressure whenever the apparatus is in operation, d. conduit means interconnecting the pump means and the interior of the rotary valve means, and e. means interconnecting the sections of the shaft, including means axially biasing the shaft segments away from each other and serving as a conduit to transmit the lubricant from the hollow interior of the rotary valve means to the hollow interior of the crankshaft means and conduit means for conducting the lubricant outwardly of the hollow interior of said crankshaft means to the outer surface of the shaft whereby the system supplies pressurized lubrication to the critical portions through the conduits.

4. A system as in claim 3 wherein the lubricant is force fed radially outwardly of said crankshaft means to bearing surfaces therealong.

5. Means retaining a segmented shaft in the form of a hollow rotary valve and a hollow crankshaft in a predetermined preload condition and serving as a conduit to conduct pressurized lubricating fluid from the interior of one segment to the interior of another segment, comprising:

a. a hollow rotating valve including means to introduce lubricating fluid into its void, said valve held in a fixed axial orientation by bearing members, b. a hollow rotating crankshaft coaxial with and adjacent to the rotating valve, said crankshaft held in position by bearing members, c. means to assure uniform rotation of the two segments, and d. a hollow elastic snubber means captured between the two segments, forcing them axially outwardly and transmitting lubricating fluid from the hollow of the rotary valve to the hollow of the crankshaft through the hollow elastic snubber means, with said hollow crankshaft having conduits leading radially outward to the surface of the throws so as to lubricate bearing surfaces thereon.

6. In an air motor having a rotary valve having an interior conduit substantially coaxial with and adjacent to a crankshaft having an interior lubrication conduit and including means drivingly interconnecting the two elements, a lubrication system to force-lubricate both elements comprising:

a. a pump means to provide a continuous supply of lubricant under pressure, b. conduit means to carry lubricant from the pump to the interior conduit of one of the elements, and c. means continuously conducting the lubricant to the other element during operation of the motor wherin the means for conducting the lubricant includes a hollow flexible member compressed between the two elements to form one continuous conduit between the conduits of the elements.

* * * * *